US011103402B2

(12) United States Patent
Fuller et al.

(10) Patent No.: US 11,103,402 B2
(45) Date of Patent: Aug. 31, 2021

(54) PNEUMATICALLY ACTUATED LIFTING CUSHION

(71) Applicants: Linn Albert Fuller, Kennewick, WA (US); Keiko Fuller, Kennewick, WA (US)

(72) Inventors: Linn Albert Fuller, Kennewick, WA (US); Keiko Fuller, Kennewick, WA (US)

( * ) Notice: Subject to any disclaimer, the term of this patent is extended or adjusted under 35 U.S.C. 154(b) by 0 days.

(21) Appl. No.: 15/602,422

(22) Filed: May 23, 2017

(65) Prior Publication Data

US 2020/0170863 A1 Jun. 4, 2020

Related U.S. Application Data

(60) Provisional application No. 62/340,497, filed on May 23, 2016.

(51) Int. Cl.

| | |
|---|---|
| ***A61G 7/10*** | (2006.01) |
| ***A47C 27/08*** | (2006.01) |
| ***A47C 20/04*** | (2006.01) |

(52) U.S. Cl.

CPC ..... *A61G 7/1021* (2013.01); *A47C 20/048* (2013.01); *A47C 27/082* (2013.01)

(58) Field of Classification Search

CPC ..... A61G 7/1021; A61G 5/1059; A61G 5/14; A61G 7/05769; A61G 7/057

See application file for complete search history.

(56) References Cited

U.S. PATENT DOCUMENTS

| | | | | |
|---|---|---|---|---|
| 5,046,205 | A * | 9/1991 | Garcia | A47C 7/021 4/456 |
| 5,996,133 | A * | 12/1999 | Fletcher | A61G 7/1007 4/237 |
| 6,082,743 | A * | 7/2000 | Black | B66F 3/35 248/188.2 |
| 6,317,909 | B1 * | 11/2001 | Blum | A61G 5/14 297/DIG. 10 |
| 9,439,822 | B1 * | 9/2016 | Davy | A61G 7/1021 |
| 2007/0234473 | A1 * | 10/2007 | Kaufman | A61G 7/1094 4/566.1 |
| 2010/0199424 | A1 * | 8/2010 | Goldner | A47C 7/14 5/83.1 |
| 2011/0185508 | A1 * | 8/2011 | Hsu | A61F 5/34 5/706 |

(Continued)

*Primary Examiner* — Sarah B McPartlin

(57) ABSTRACT

This device relates to a pneumatically inflatable cushion, which is lightweight, portable, extremely durable, and aesthetically attractive. The device is an inflatable cushion designed to assist in raising and lowering people who are unable to move freely by themselves. It is designed to support, horizontally stabilize, and center a person sitting on the cushion. This device can be used in the bathtub while exposed to water, and on regular surfaces both indoors and outdoors. This device is also designed to provide lift and support on solid surfaces and on water surfaces. This device is also designed to assist in the raising and lowering of objects, both living and non-living. The height and width can be easily customized and adapted to the needs of the user. This device may be used individually or connected with multiple units to form a larger monolithic device capable of lifting larger and heavier loads.

14 Claims, 16 Drawing Sheets

Above is an example of one embodiment of a portable cushion lift.

(56) References Cited

U.S. PATENT DOCUMENTS

| | | | | |
|---|---|---|---|---|
| 2012/0297540 | A1* | 11/2012 | Thomas | A61G 7/0507 5/424 |
| 2014/0007343 | A1* | 1/2014 | Davis | A61G 7/1021 5/83.1 |
| 2017/0049646 | A1* | 2/2017 | Rigoni | A61G 7/05769 |
| 2017/0071805 | A1* | 3/2017 | Geva | A61G 7/1021 |
| 2017/0231846 | A1* | 8/2017 | Farrington | A61G 7/1011 5/83.1 |
| 2018/0085268 | A1* | 3/2018 | North | A61G 7/1011 |

* cited by examiner

Above is an example of one embodiment of a portable cushion lift.

PNEUMATICALLY ACTUATED LIFTING CUSHION

CROSS-REFERENCE TO RELATED APPLICATION

This application claims the benefits of provisional patent application Ser. No. 62/340,497, EFS ID No. 25862284, filed May 23, 2016 by Linn Fuller.

BACKGROUND

With an increasing number of people living longer, there are a great number of elderly people who are infirmed due to age and have weakness in their muscles and joints. Furthermore, there are many people who are temporarily or permanently disabled due to physical illness, injuries, birth defects or medical procedures such as surgery. Also, many people are physically weak for their body size and lack sufficient strength in their arms, legs, and back to move up and down freely.

Many of these people are able to walk and function in a normal setting but struggle to lower themselves to a position on the floor or the ground and then raise themselves back to an upright position. These people are simply unable to move easily and confidently to and from the floor, or into and out of a bathtub.

These physically challenged people are also limited in the kind of activities in which they can participate; they are often unable to join others in any activity which requires moving to a seated position on the ground or floor. These include indoor activities such as playing with pets or young children on the floor, or performing household repairs and cleaning. Even more challenging are outdoor activities such as gardening and yard work, or attending events such as picnics, camping, fireworks displays, and so forth.

Lack of sufficient muscle strength, or weakness in the joints causes many people to also struggle to rise from a sitting position in a wheelchair, from a seated position on normal household furniture, from a car seat, and even from a seated or reclined position on a normal bed.

In many circumstances these people are given care by someone who acts as a personal assistant. One of the greatest challenges and risks to the caregiver is assisting the person receiving care as they move up or down in the bathtub. This often results in a serious physical injury to the caregiver due to the strain of the weight of the person they are assisting and the awkward body position required when giving help and support. This causes pain and suffering in the back, shoulders and neck for the care provider. In situations such as these, a mobile personal lifting device would be a great help for both the care giver and the care receiver.

PRIOR ART

Currently there are a number of solutions for personal lifting devices. Some of these solutions attempt to use devices which include slings and pulleys, but these solutions fail to meet the needs of the industry because they are awkward and generally immobile from one location to another. Other solutions attempt to use a mechanical lifting and lowering chair, but these solutions are also unable to meet the needs of the industry because the device is often narrow and confining for people of larger stature, fails to provide a comfortable experience for the user, and again is difficult to relocate when needed. This type of lifting chair device also tends to be expensive to purchase, difficult to assemble and install, and challenging to operate.

Still other solutions seek to create an inflatable pillow structure made of welded vinyl or plastic, but these solutions also fail to meet industry needs because the device is not puncture resistant to sharp objects, not durable in many outdoor environments, and therefore is not designed to be used in a variety of situations other than indoors. With such a design, significant damage to a single area of the inflatable device would require replacement of the entire welded plastic structure. This is both costly and impractical. This design essentially limits its use to smooth indoor environments such as bathtubs or areas inside a house or a similar living facilities.

Furthermore, most of these inflatable devices are designed to be securely attached to the surface of the bathtub with strong suction cups or a similar supporting structure which greatly limits the movement and comfort of the user while in the bath. When used in areas other than bathing, the suction cup attachments on the bottom of these devices results in an unstable condition and difficulties with balance and horizontal integrity. Some such inflatable devices rely on poles or rods inserted into mounting points at the base of the inflatable cushion. These add to the stability of the device but again greatly limit the range of movement of the user in a bathtub setting.

SUMMARY

There currently exists a need in the industry for a device and method that can help people when entering and exiting a bathtub. Such a device could also assist when recovering to a normal position after an accidental fall to the ground or the floor. The present innovative design advantageously fills the aforementioned deficiencies by providing an inflatable cushion engineered to assist in raising and lowering people who are unable to move freely by themselves. The device and method presented here provides products which are unlike previous devices and designs.

Unlike other devices used previously for similar situations, this new device has soft, round, inflatable air tubes covered with durable, water-resistant fabric which readily conforms to the shape of the person being assisted. This cushion lift naturally and gently stabilizes and supports the buttocks of the person while movement takes place. The water resistant fabric cover can be constructed to create the desired shape and size required for the various applications. The method for using the device and lifting a person includes a simple action of pressing a hand-held start and stop button. The method for deflating and lowering a person includes a single action of opening an air release valve.

Also unlike other devices used previously in bathing situations, this device specifically does not incorporate an anchoring or securing device such as suction cups or bracing mechanisms for limiting the horizontal movement of the device. When deflated and essentially flat, this device is intentionally designed for ease of movement across the bathtub surfaces upon which it is placed. This allows the user to easily relocate to either a seated position or a reclining position during the bathing experience. This design also allows the easy removal and replacement of the cushion in the bathing area in the event the user prefers to remove it entirely. However the design of the bottom foam support ring greatly increases the horizontal stability of the cushion and limits the forward, backward, and side-to-side leaning movement of the cushion when inflated. This foam support ring also helps to center the user when the cushion is deflated.

The design principles used in this device can be included in a wide variety of embodiments. Using one embodiment of this device, a person with limited mobility can be assisted to move safely into and out of a bathtub, or up and down from the floor. In another embodiment this device can also assist people who wish to safely move to and from a low level chair, couch or bed, with or without the assistance of a caregiver. In another embodiment this device can also be used to lift or lower various heavy or awkward items including people lying down, animals, and objects. This lessens the chance of personal injury to the user. Another embodiment allows this device to be used simply as a portable device for sitting upon with comfort while the cushion is either inflated of deflated.

This lifting cushion can optionally be connected with other similar devices and configured to act in unison to provide greater lift in a wide variety of situations. In every case it reduces the physical risk to those involved, and provides a useful tool for moving heavy loads.

This new device can be used conveniently in a variety of situations due to its construction of durable materials, lightweight components and simple method of set-up, operation, dis-assembly, and storage. This device is designed to be readily used indoors and outdoors, on either smooth or rough surfaces, and on solid or liquid surfaces.

The present invention now will be described more fully with reference to the accompanying illustrations. These illustrations are intended to be read in conjunction with both this summary, the detailed description, and any preferred and/or particular embodiments specifically discussed or otherwise disclosed or implied. However this new device may be embodied in many different forms and should not be construed as limited to the embodiments set forth herein. Rather, these proposed embodiments are provided by way of possible options only, and so that this disclosure will be thorough, complete, and will fully convey the entire scope of the invention to those skilled in the art.

REFERENCE NUMBERS BRIEFLY IDENTIFYING THE COMPONENTS

Figure 1:
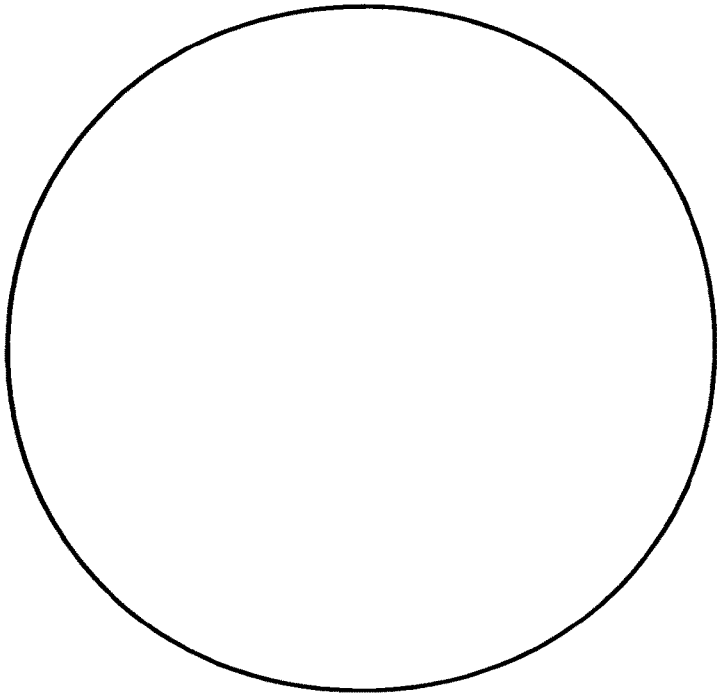
FIG. 1. The shape of the top layer of the container from above.

101. Remotely controlled, wireless on/off switch.
102. Electrical power cord.
103. Air pump.
104. Air pressure by-pass valve.
105. Air supply hose.
106. Inline check valve.
107. Air pressure release valve.
108. Top foam support with a fabric cover.
109. The completed cushion including a fabric outer container and expandable inner air bladders.
110. Bottom foam support with a fabric cover.
111. Optional fabric handle used to move or relocate the cushion.
112. The top fabric layer and seating area of the inflatable cushion which is circular in shape, for this example.
113, 114, 115.
The remaining layers of fabric for the cushion which will be circular in shape, for this example.

113A. A point of connection between layer 113 and layer 114. This can be sewn with thread or bonded using a strong adhesive agent.

113B. An additional connecting point for re-enforcement and stabilization of the finished cushion, again using thread or adhesive agent.

116. Fabric straps used to stabilize and restrain the inflatable bladders in a central location inside the fabric cover.

116A. Hook and loop adhesive fabric pieces attached to the fabric to secure the ends of the straps.

118A. The completed fabric outer container comprising two compartments, as seen from the top.

1188. The completed fabric outer container comprising two compartments, as seen from the bottom with the access opening.

118C. The completed fabric outer container comprising two compartments, as seen from the top with the foam support.

118D. The completed fabric outer container comprising two compartments, as seen from the bottom with the foam support and the access opening.

119. Inflated expandable bladders which can support the fabric outer container.

119A. Top view of the inflated expandable bladders, complete with air hoses and connections.

119B Side view of the inflated expandable bladders, complete with air hoses and connections.

120. Expandable bladder connective opening, or air tube inlets.

121. Soft hoses used to carry the compressed air from the air supply hose to the expandable air bladders.

122. Transition fitting which connects the soft air hoses from the expandable air bladders to the air supply hose.

123. A natural low pocket in the center of the cushion which stabilizes and supports the buttocks of the user. This is also described as a natural bowl-shaped area of the cushion.

124. The optional third layer of the inflatable cushion.

125. The optional plastic handle which can be attached with suction cups to the bath tub or the wall area around the bath tub.

126. Alternate pattern with the completed inflated cushions connected as a 'lifting-bed'.

127. Example of a firm flat surface used when a person or load is raised or lowered.

128. Alternate pattern with the completed inflated cushions being connected as a 'raised-platform'.

129A. Top view of a single layer inflated expandable bladder.

129B. Side view of the same single layer inflated expandable bladder.

130. A single-layer lifting cushion which can be used on chairs, couches, beds, etc.

DETAILED DESCRIPTION PROVIDED WITH THE ILLUSTRATIONS

Illustration 1/17

Figure 2:
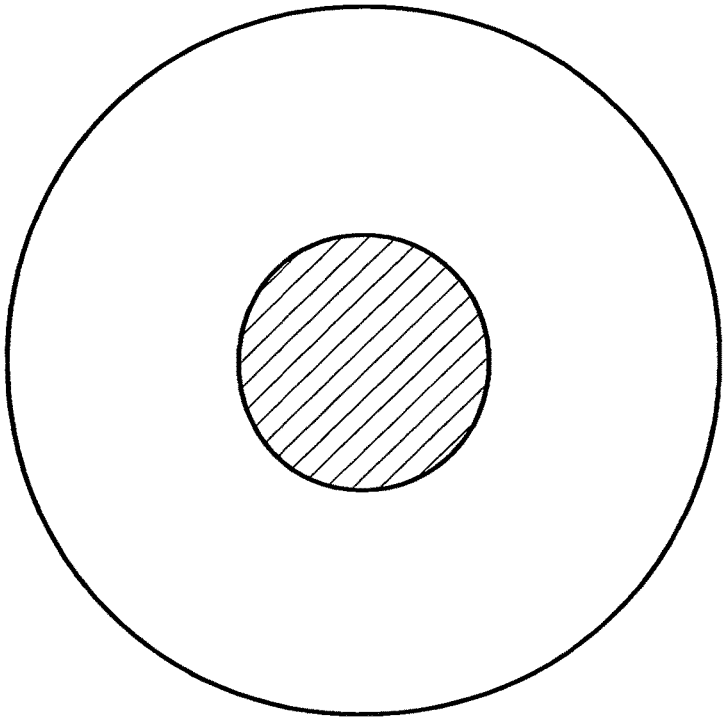
FIG. 2. The shape of the lower three layers of the container from above.

FIG. 1 shows the top layer of fabric which is in the shape of a circle. FIG. 2 shows the second, third, and forth layer which are in the shape of a ring.

Illustration 2/17

Figure 1A:
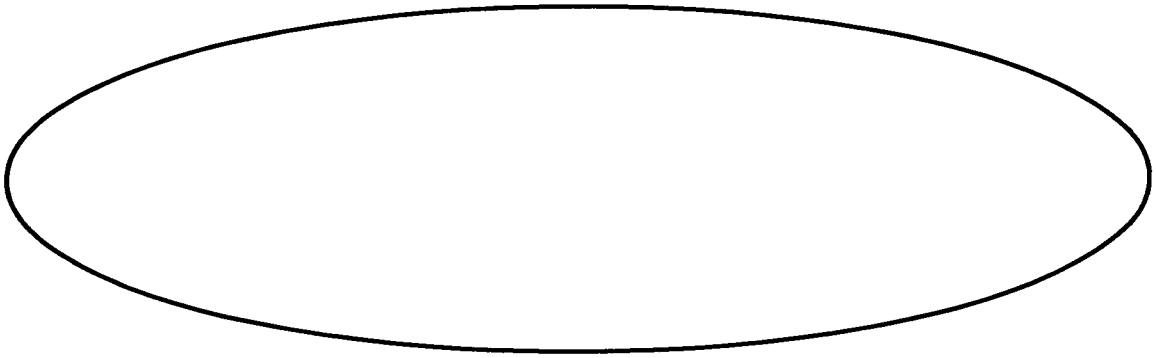
FIG. 1A. The shape of the top layer of the container from the side.
Figure 2A:
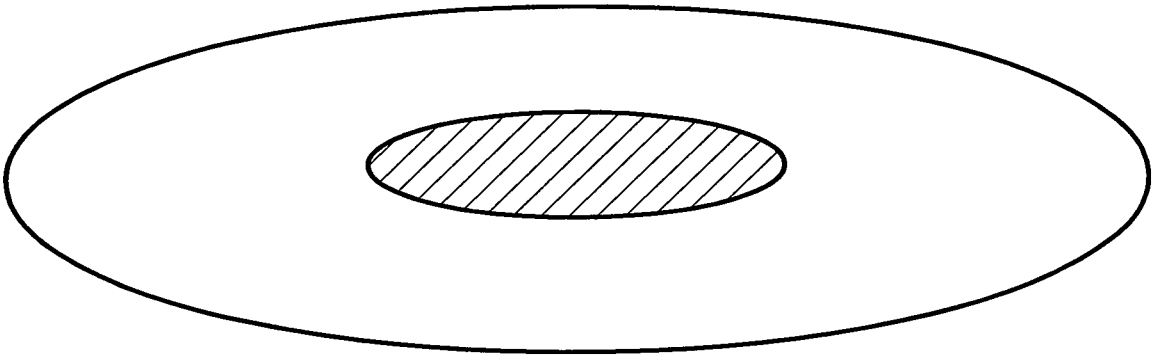
FIG. 2A. The shape of the lower three layers of the container from the side.

FIGS. 1A and 2B are FIGS. 1 and 2 shown from an angle.

Illustration 3/17

Figure 3:
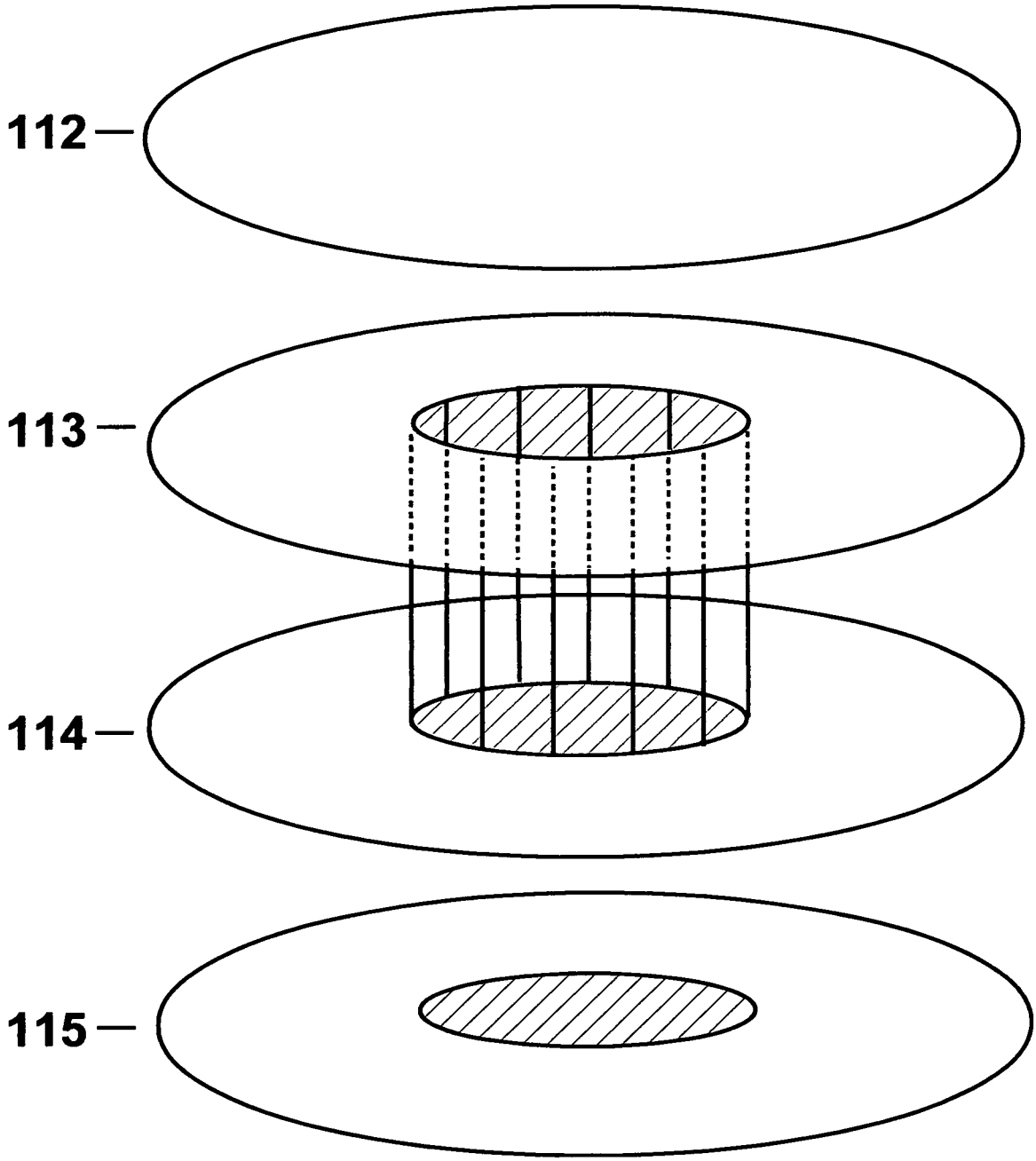
FIG. 3. The four layers making up the outer container showing the connecting points between layers 113 and 114.

FIG. 3 shows lines that indicate the area of the fabric layers 113 and 114 to be contiguously joined.

In the center of the bottom three layers of fabric 113, 114, 115 is a hole which is used to access the interior of the device. These openings allow the placement of the inflatable air bladder inside the closed compartment after initial construction is complete.

Illustration 4/17

Figure 4:
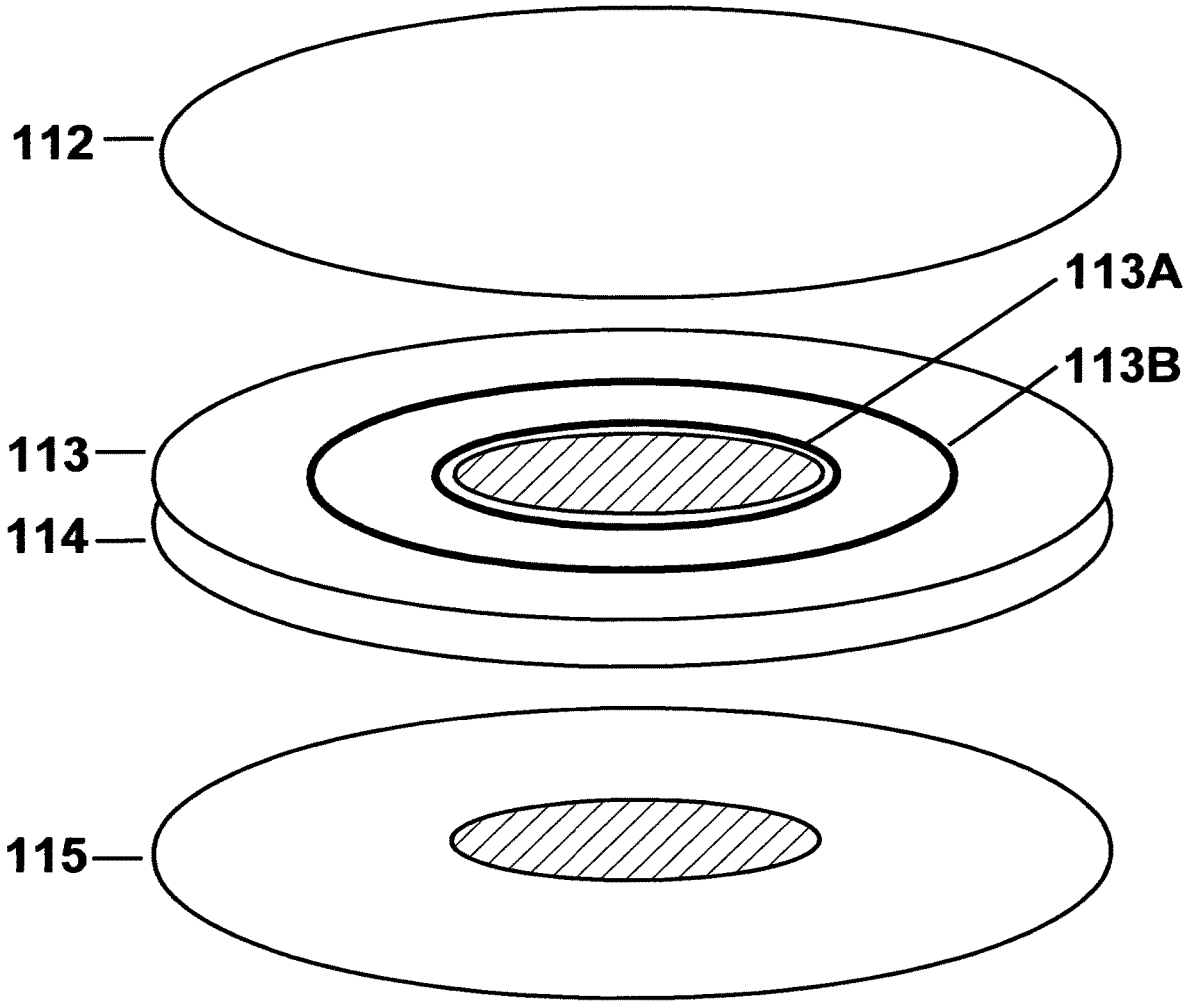
FIG. 4. The four layers making up the outer container showing layers 113 and 114 connected near the center opening.

FIG. 4 shows fabric layers 113 and 114 having been joined together around this center opening, 113A. There is an additional connection in the area midway to the outer perimeter between the upper and lower compartments, 113B. This increases horizontal stability between the two compartments when the expandable bladders are fully inflated.

Illustration 5/17

Figure 5:
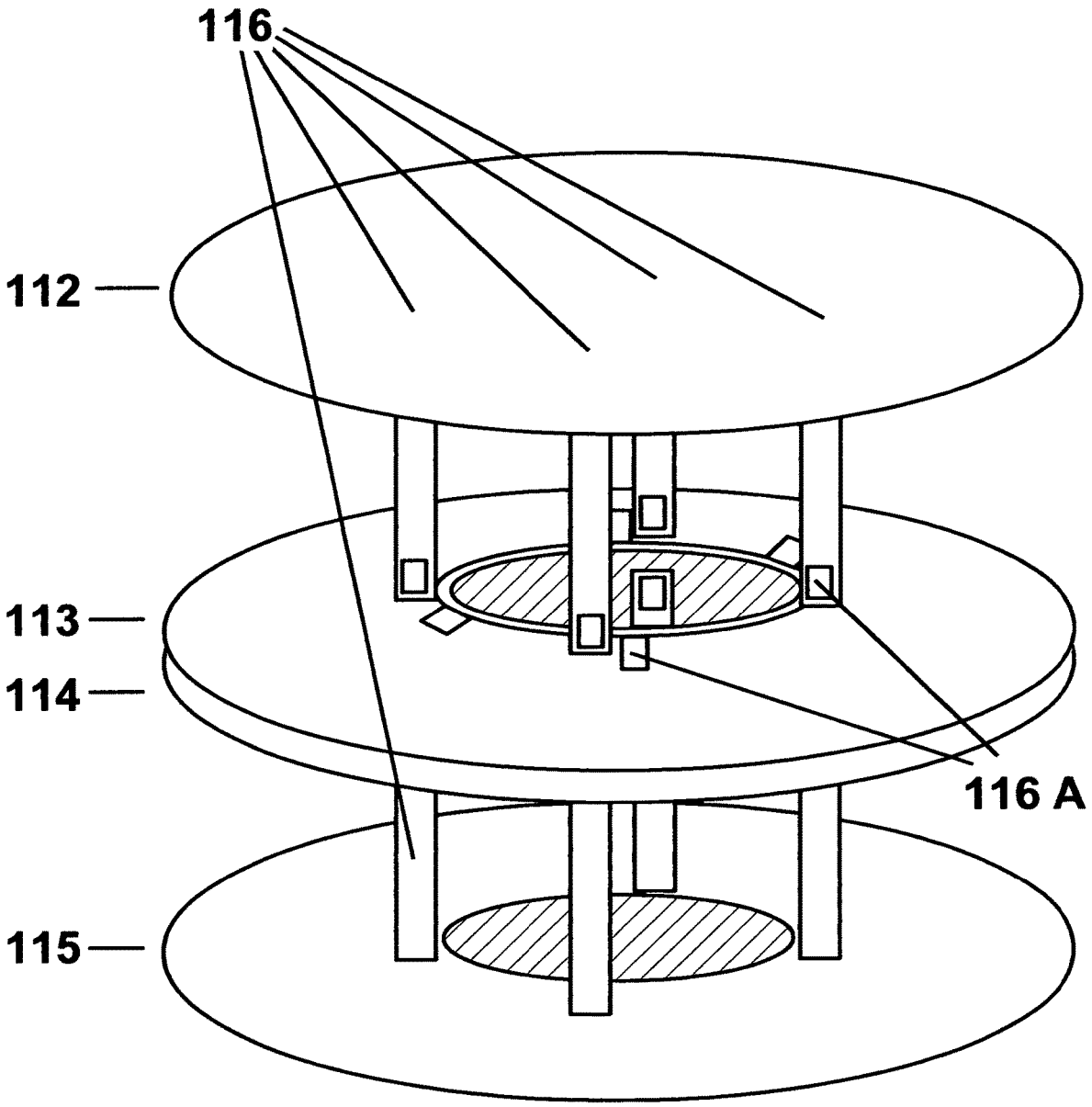
FIG. 5. The four layers making up the outer container showing the attached retaining straps and the attached hook and loop fabric pieces.

FIG. 5 shows hook and loop adhesive fabric pieces, 116A, attached around this center access opening. Complimentary hook and loop pieces are attached to one end of the fabric straps 116, and the opposite end of the straps will be permanently attached to fabric layers 112 and 115. After final assembly of the cushion these eight fabric straps 116 will be secured to the fabric layers 113 and 114 by the detachable hook and loop fabric ends in order to keep the expandable bladders securely located and centered while the cushion is in use.

Illustration 6/17

Figure 6:
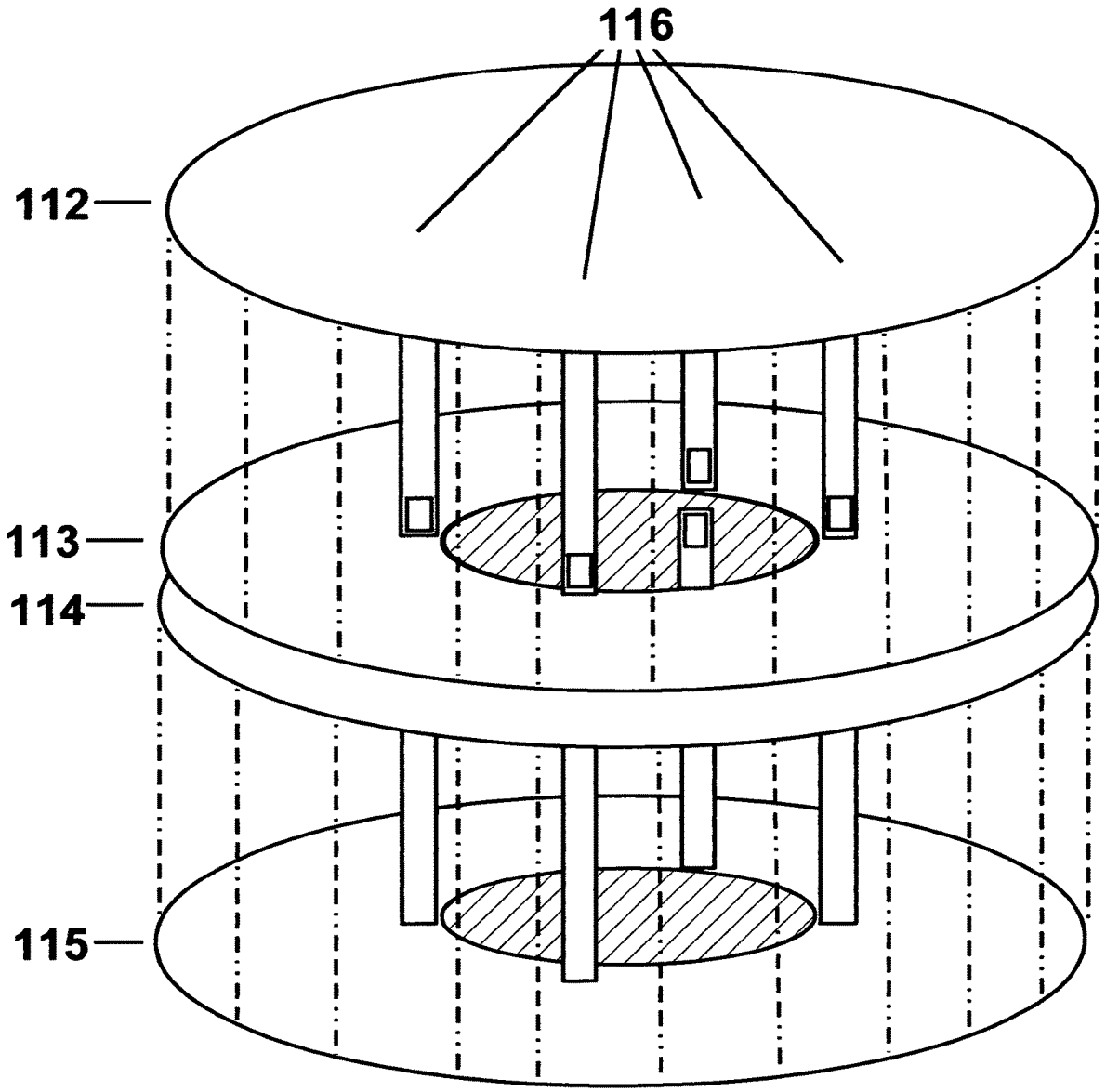
FIG. 6. The four layers making up the outer container showing the connecting points between layers 112 and layer 113, and also between layer 114 and layer 115. Both connections are only at the outer perimeter of the pieces.
Figure 7:
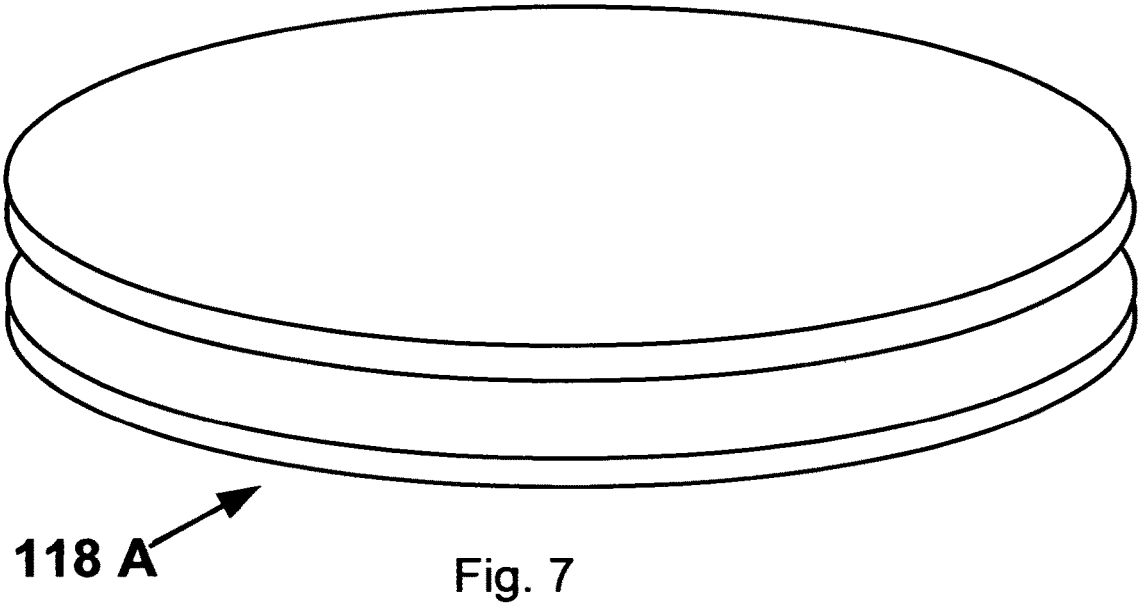
FIG. 7. The four layers making up the outer container showing the completed shape after the perimeters have been joined. For this embodiment, the container has two inner compartments.
Figure 8:
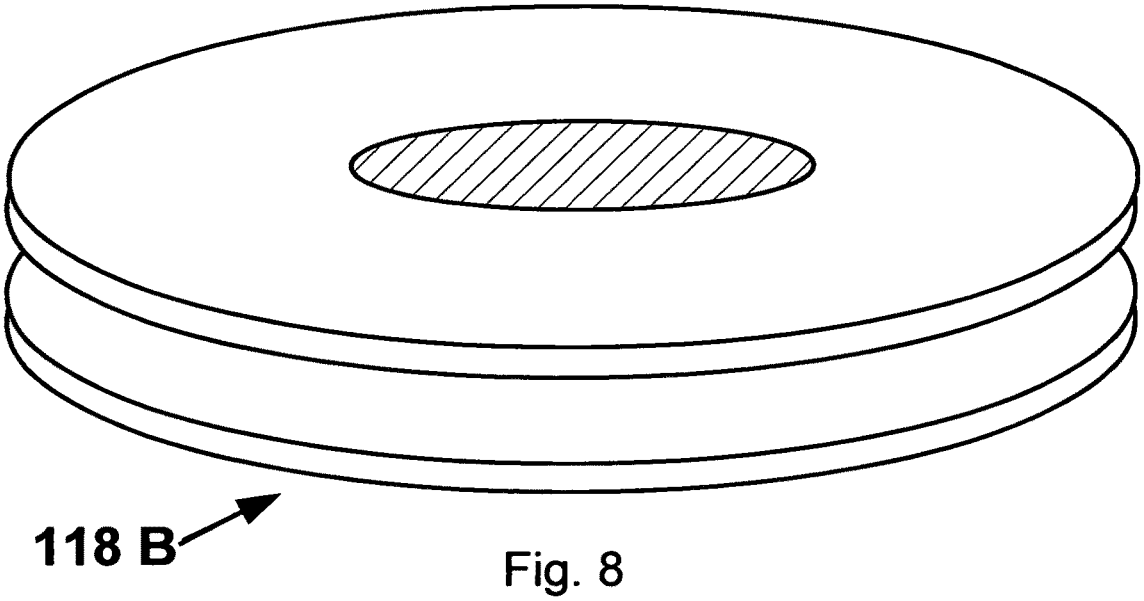
FIG. 8. The four layers making up the outer container shown in FIG. 7, as seen from the bottom and showing the access opening.
Figure 9:
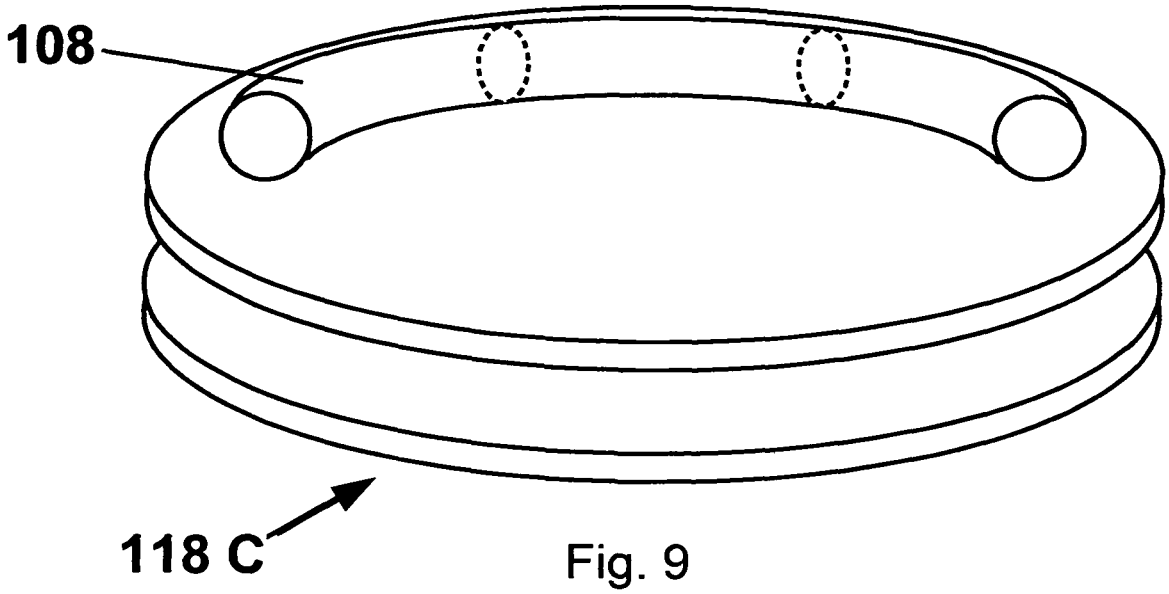
FIG. 9. The outer container as shown in FIG. 7, with the top foam support attached using a fabric sleeve around the support.
Figure 10:
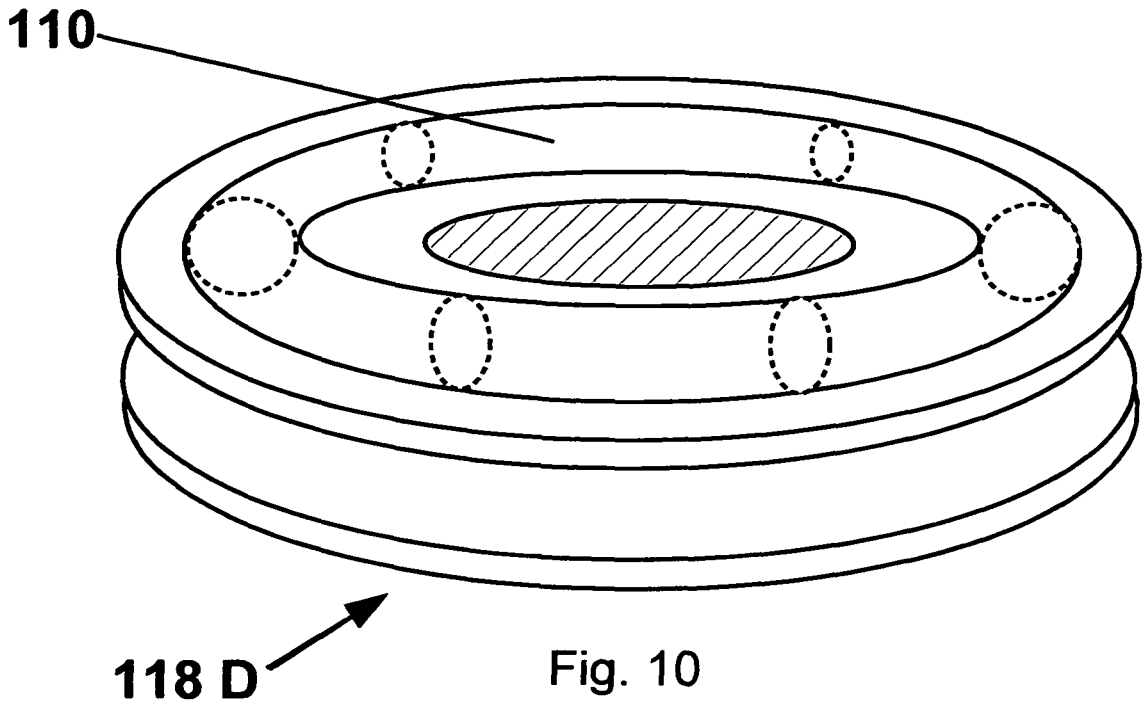
FIG. 10. The outer container as shown in FIG. 8, with the bottom foam support attached using a fabric sleeve around the support.
Figure 11:
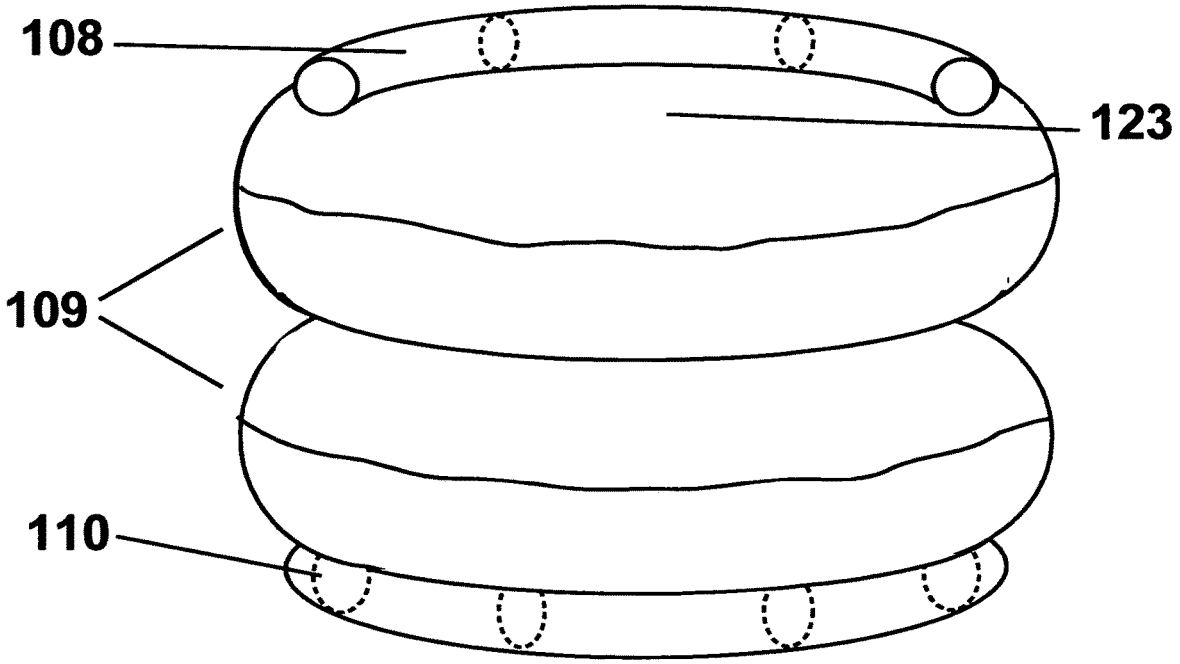
FIG. 11. The completed cushion containing inner expandable bladders, with foam supports attached on the top and bottom using a fabric sleeve around the supports. This is one possible embodiment of this device referred to as a 'personal cushion lift'.
Figure 12:
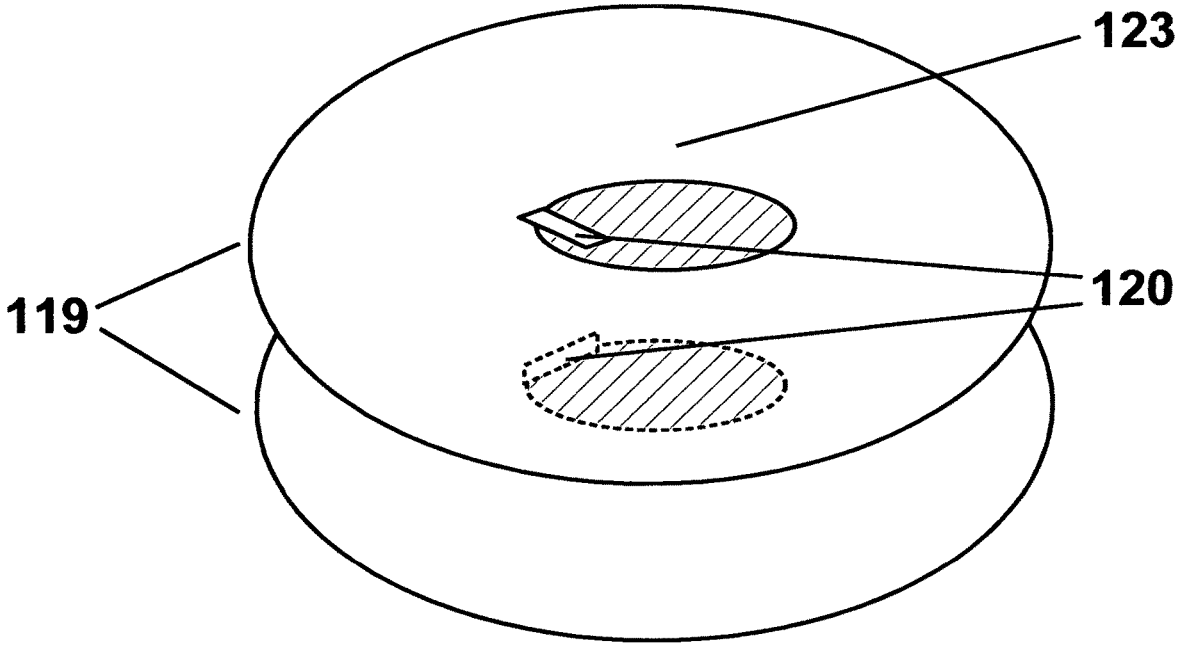
FIG. 12. The expandable air bladders which are placed within the outer container, complete with expandable bladder connective openings. These connective openings may also be called air tube inlets.
Figure 13:
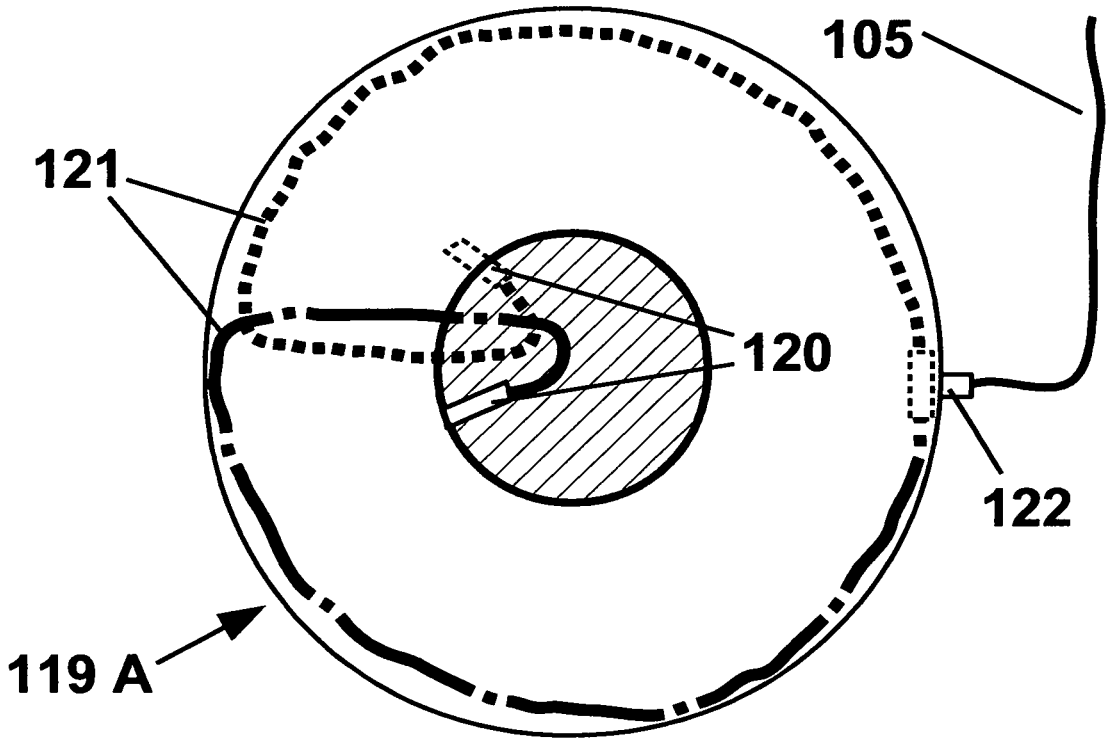
FIG. 13. The expandable air bladders shown from the top view, also showing the air tube inlets, the soft air hoses, the transition fitting, and the air supply hose.
Figure 14:
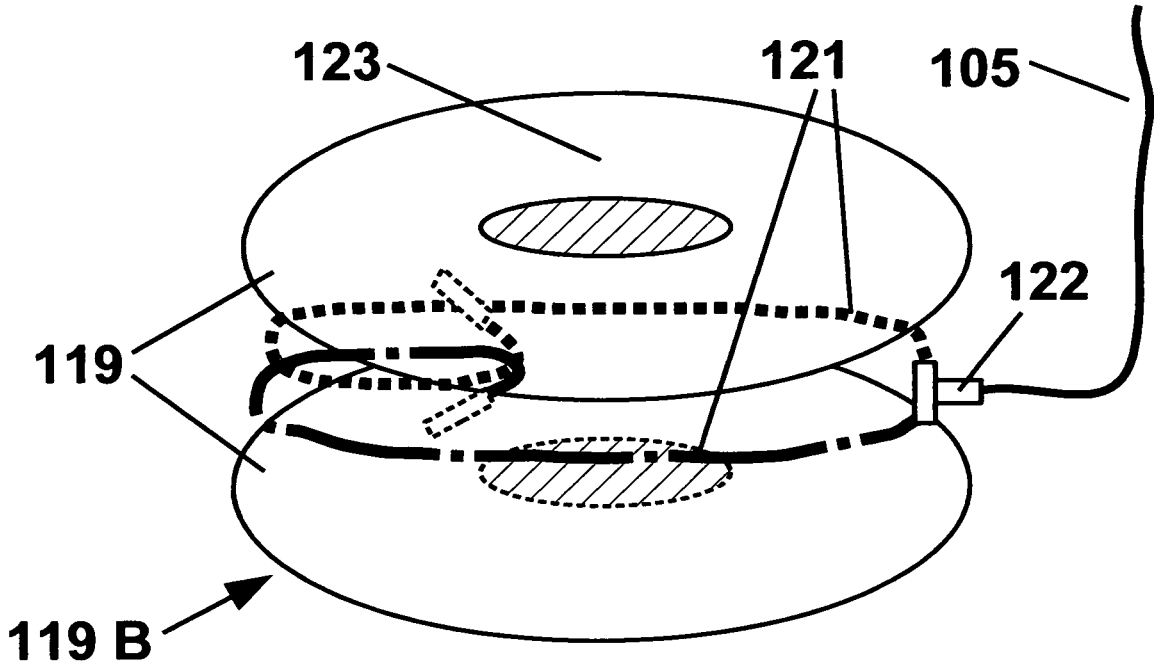
FIG. 14. The expandable bladders as shown in FIG. 13, shown from a side view.
Figure 15:
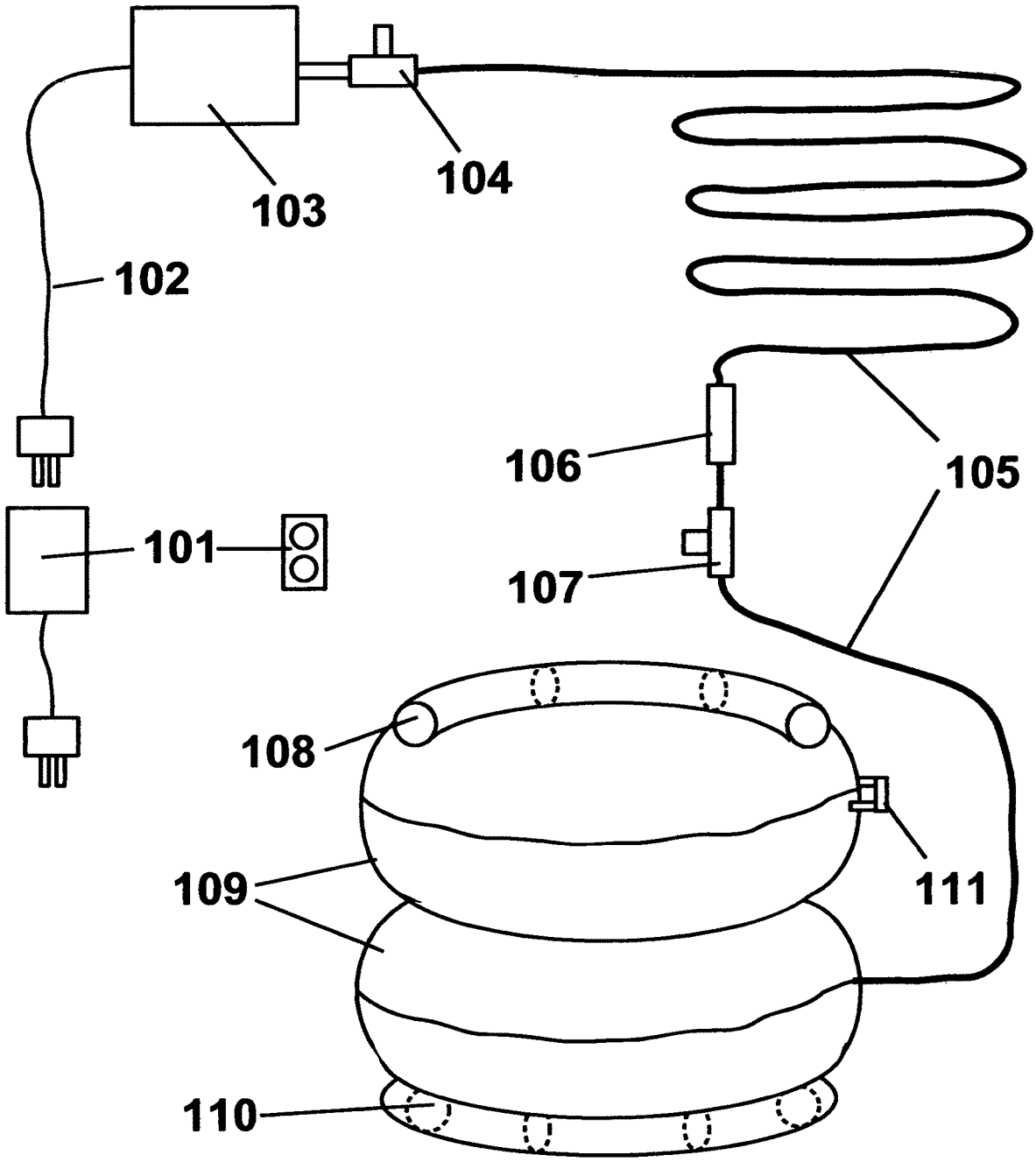
FIG. 15. An example of one complete embodiment of a cushion lift, as described in this application. The ancillary parts 101 through 107 are typical, but not required, for this device.
Figure 16:
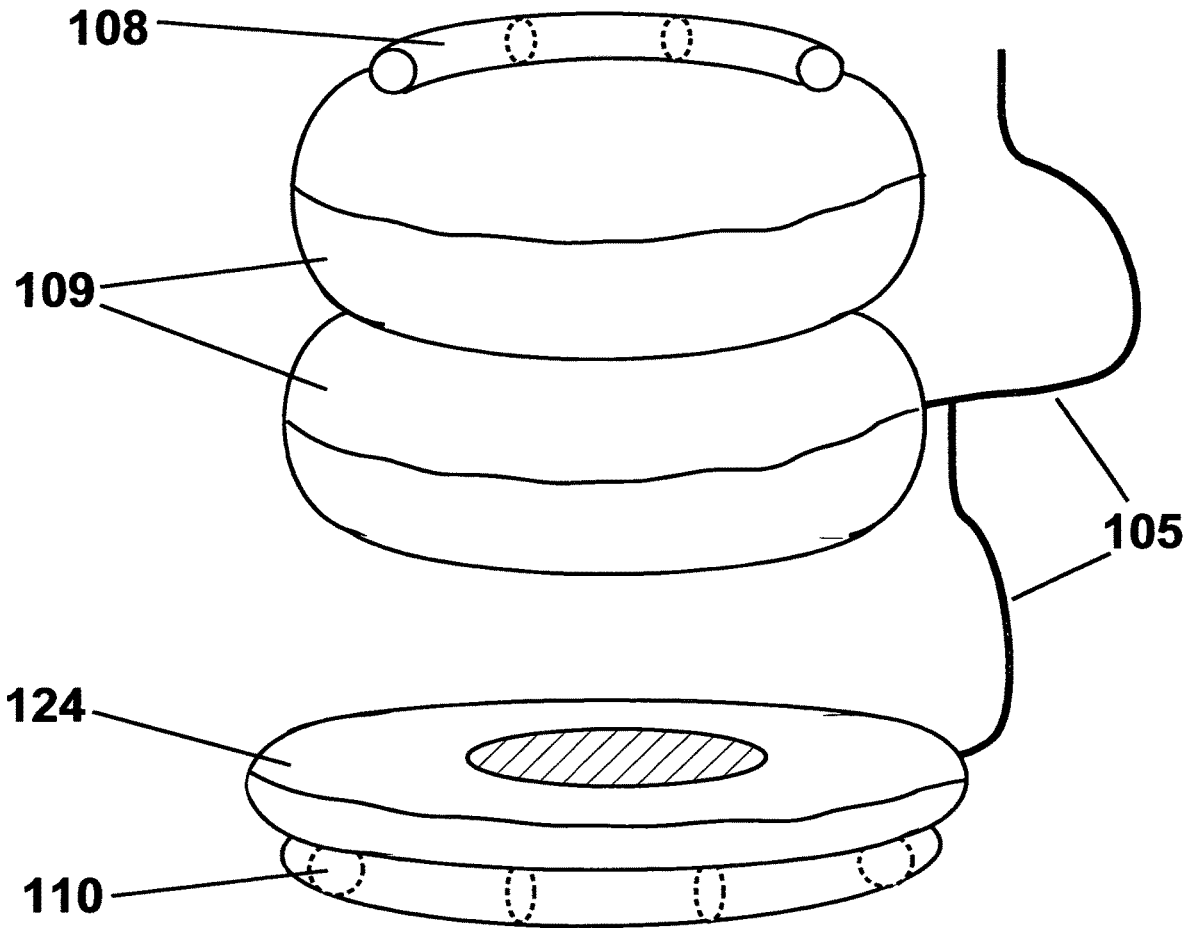
FIG. 16. The completed cushion lift with two compartments, shown above an optional third compartment which can be attached using the same construction process. The third compartment adds height to the device.
Figure 17:
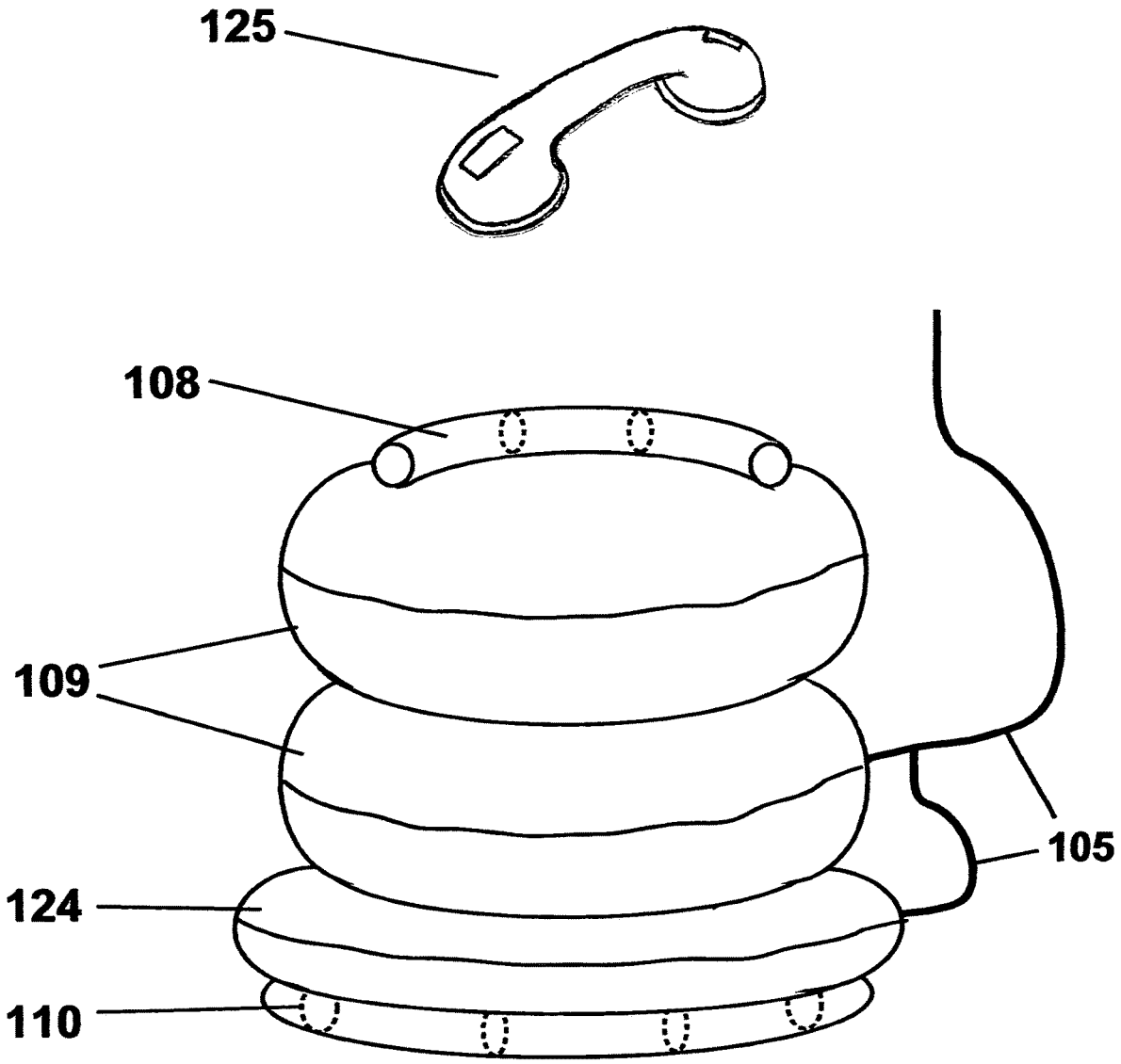
FIG. 17. The completed cushion with three compartments. This is another possible embodiment of this device referred to an 'extended cushion lift'. Also shown is a detachable plastic handle used for optional support.
Figure 18:
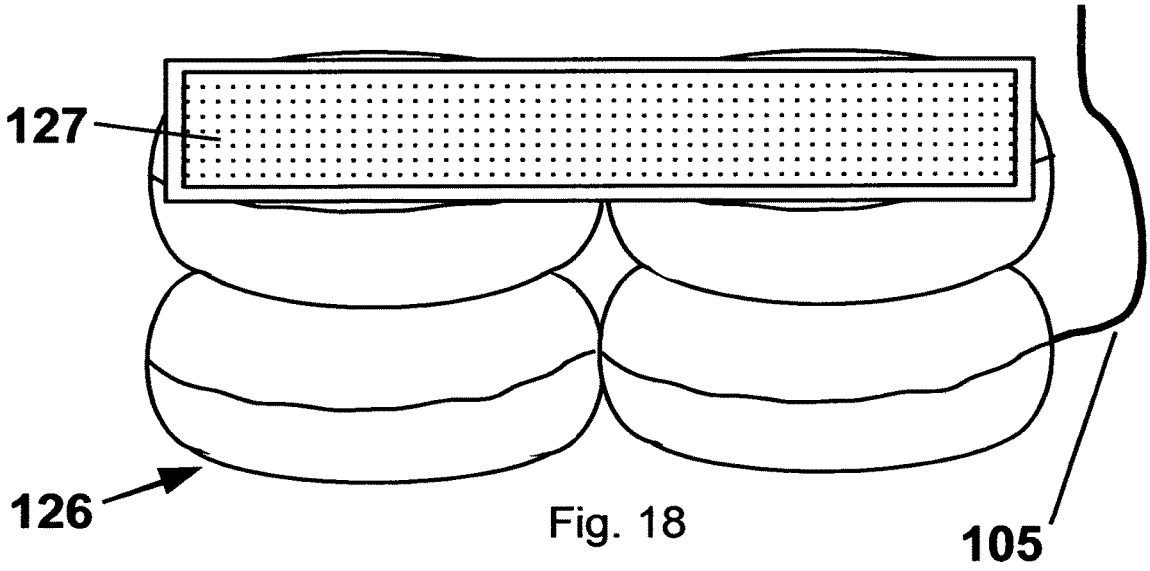
FIG. 18. The completed cushion lift attached together to form a lifting device with four compartments, which may be referred to as a 'cushion lift bed'. This is another possible embodiment of this device. This example includes a firm, flat surface for support of the load being lifted.
Figure 19:
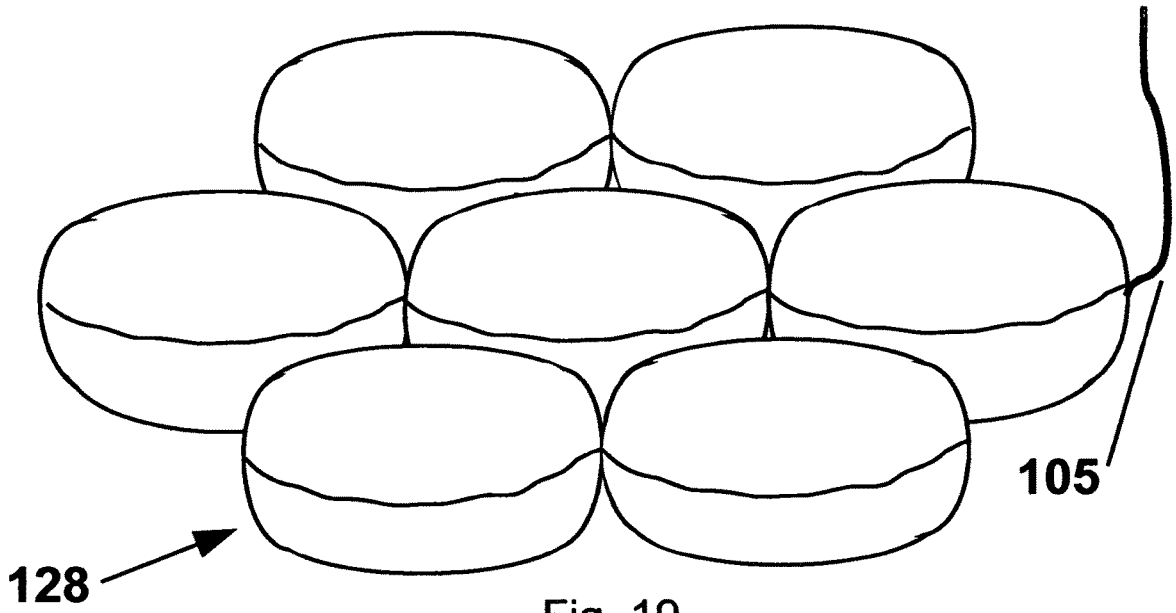
FIG. 19. The completed cushion lift attached together to form a lifting device with multiple compartments. This may be referred to as a 'cushion lift platform'. This is another possible embodiment of this device.
Figure 20:
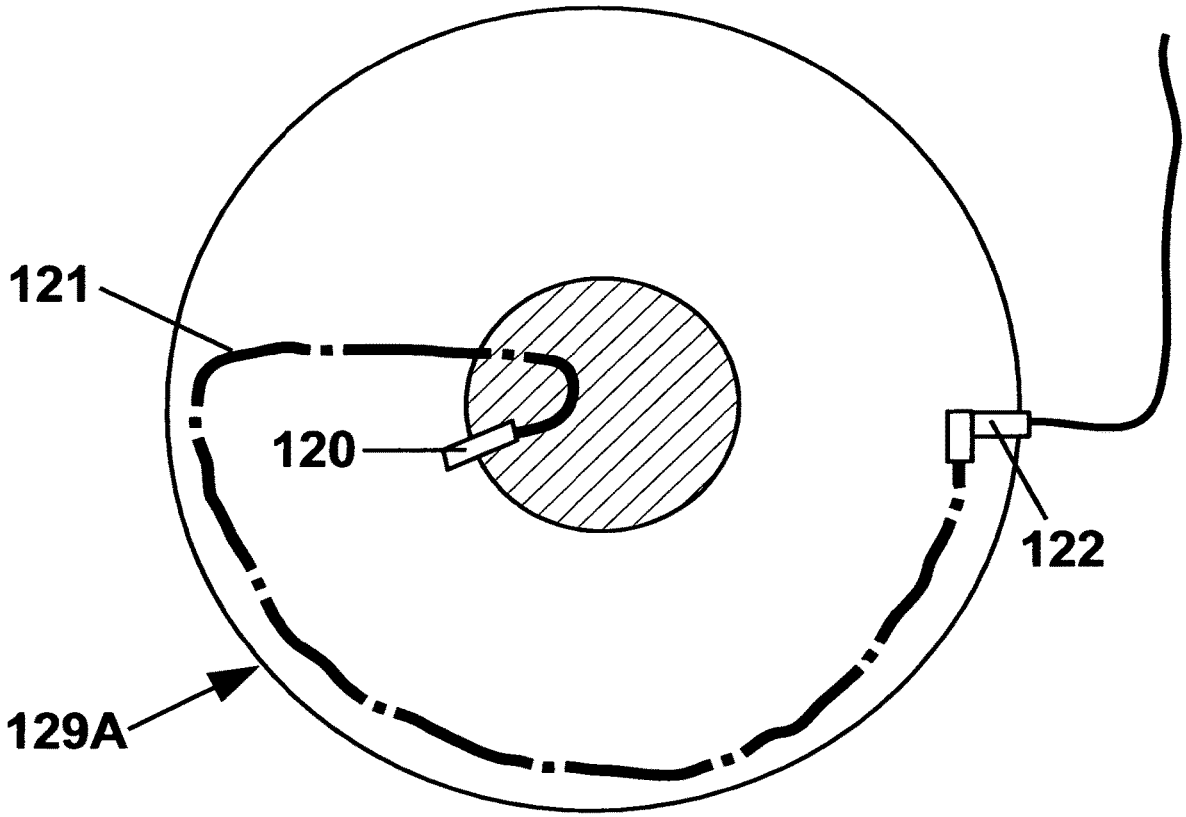
FIG. 20. A single expandable air bladder shown from a top view, also showing the air tube inlet, the soft air hose, the transition fitting, and the air supply hose.
Figure 21:
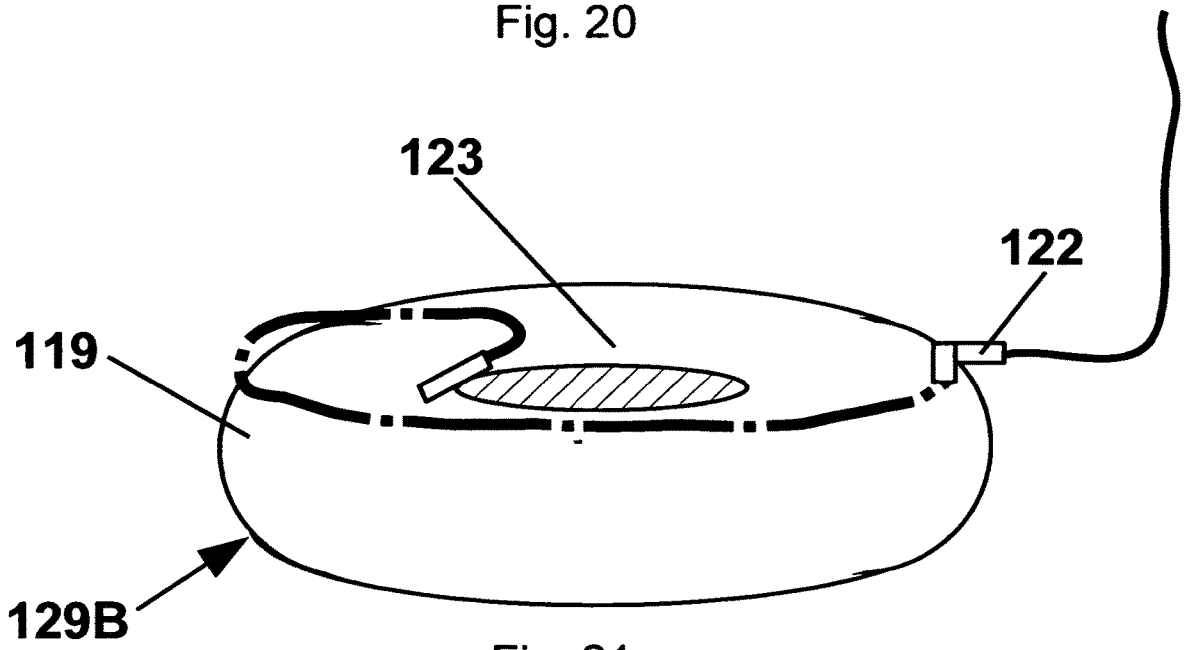
FIG. 21. A single expandable air bladder as shown in FIG. 20, shown from a side view.
Figure 22:
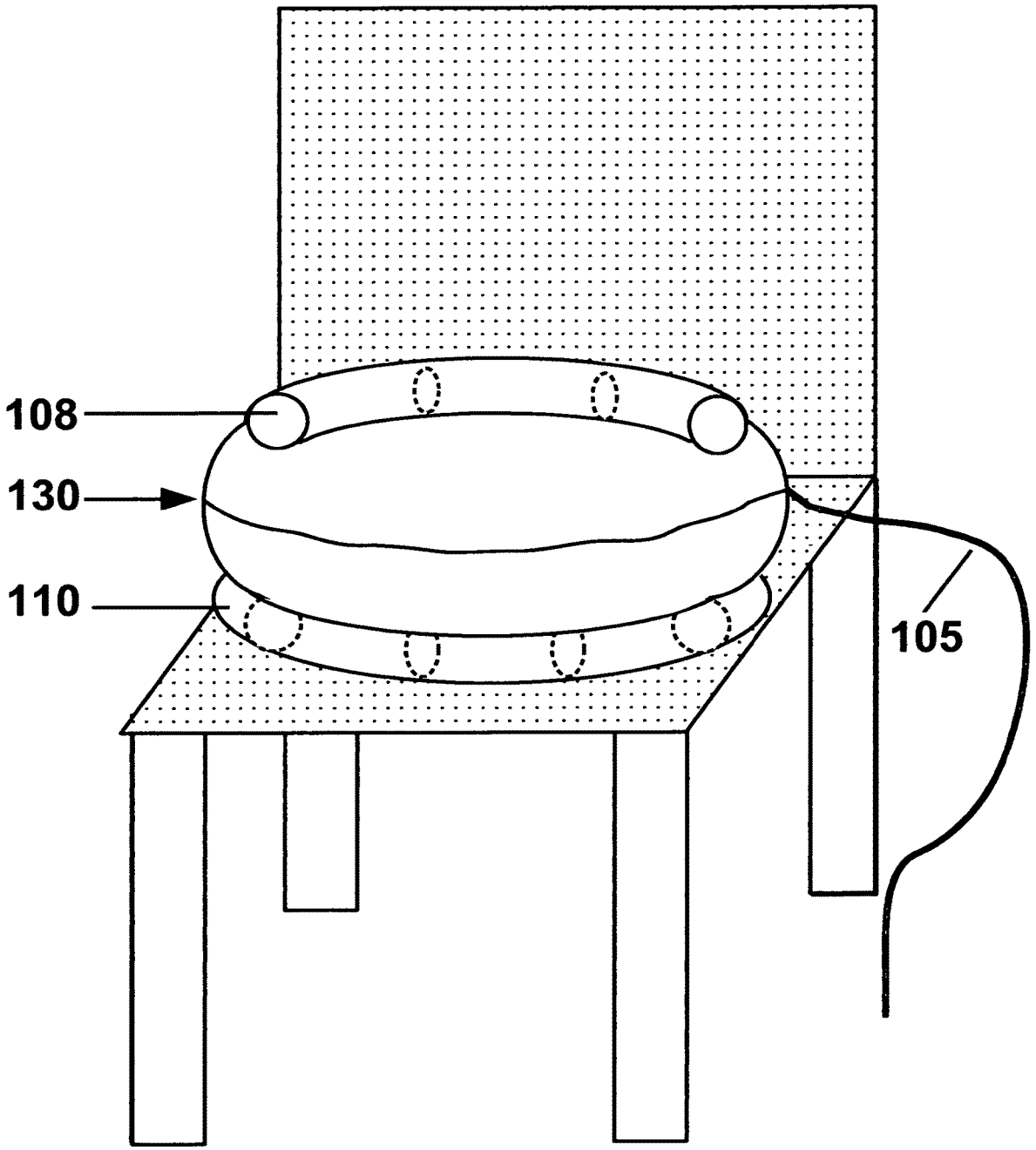
FIG. 22. The completed cushion lift made with a single compartment. This is another possible embodiment of this device which may be referred to as a 'cushion lift chair'.

FIG. 6 shows the final step of initial construction of the outer container. The outside perimeter edge of fabric layers 112 and 113, and fabric layers 114 and 115 are joined together in order to connect the fabric. This creates the two compartments inside this cushion.

Illustration 7/17

The completed basic cushion with the seat facing upward 118A, and the completed basic cushion with the seat facing downward 118B.

Illustration 8/17

Foam tubes 108 and 110 support and stabilize the inflated cushion, and the user. These foam supports are attached to the outside fabric surface on the bottom and top. The top of the cushion 118C, shows the seat facing upward. The bottom of the cushion, 118D, shows the completed cushion with the access opening facing upward.

Illustration 9/17

Completed external fabric container 109 with two internal compartments holding inflated air tubes 119. Foam support rings 108 and 110 on the top and bottom. Two internal inflated air tubes 119 will support the external fabric container. The natural bowl-shaped area of the cushion 123 stabilizes and supports the buttocks of the user when the cushion is used as a sitting device.

Illustration 10/17

The inflatable air bladders 119 may be filled with compressed air by means of soft air hoses 121 made of vinyl, plastic, rubber, or a similar compliant material. The hoses will be held in place by a channel or sleeve sewn to the inner layer of the fabric and routed around the outer perimeter of the cushion so as to not interfere with the center seating position of the cushion's user. The air bladder inlets 120 are connected by the soft air hoses 121 to a transition fitting 122 where they become a single air supply line 105, pass through the outer fabric layer and continue to the air pump. This construction design allows the center of the deflated cushion to be relatively smooth and flat for the person using it for a sitting device.

The 'doughnut' shape and design of the expandable bladder 119 will create a natural low pocket 123 in the top fabric surface of the cushion. This natural low pocket 123 in the center of the cushion stabilizes and supports the buttocks of the user.

The expandable bladder 119 of the device are referred to as 'doughnut-shaped' or 'ring-shaped' not because of the round shape of the exterior but due to the hole in the center of the inflatable air tube. Using expandable bladders in a similar way, devices can be made which have a shape to the outside fabric which will be determined by the application. For example, the outside shape can be rectangular, square, triangular, oval, etc., but in each case a hole in the center of the expandable bladder will allow the finished cushion to have a natural low pocket 123 in the middle of the seating area which centers and supports the buttocks of the user.

Illustration 11/17, one embodiment of a 'personal cushion lift' with supporting components.

101. A remotely controlled, wireless, on/off switch. A power switch which allows the air pump to be remotely started and stopped by means of a wireless push-button.

102. An electrical power cord. An electric cord which receives power from the remotely controlled power switch. The electricity can be either alternating current or direct current.

103. An air compressor, or air pump. A small electric air pump which will be located at a safe distance from the inflatable cushion (approximately 6 meters). This will substantially isolates the user from the source of the electricity.

104. An air pressure by-pass valve. A spring actuated air by-pass valve which will open at a predetermined line pressure (for example, 4 psi) when the cushion is properly inflated. This automatically stops the input of additional air into the cushion which prevents the cushion from being over inflated. When this by-pass valve opens, a stream of escaping air creates a signals which alerts the user to stop the air pump by pressing the remote control power switch. This by-pass valve is set at the time of manufacture and is not normally adjusted by the user. This by-pass valve is attached permanently in the air hose and cannot be casually removed.

105. An air supply hose. A small diameter (for example, 1 cm) air hose which allows the compressed air to move to the cushion. This hose can be made of a strong and yet supple material such as vinyl, plastic or rubber to avoid being pinched or kinked. Pinching or kinking of the hose would cause the free flow of air to be interrupted. This air hose can be any length which allows a safe distance between the user and the air pump's power source.

106. An inline check valve or flow-control valve. This allows the flow of air toward the cushion only. This keeps the pressurized air in the cushion. It also prevents back-flow of air and moisture in the system when the by-pass valve opens or when the compressor is stopped. By preventing back-flow of any liquid, the check valve prevents damage to the air pump or personal injury to the user. This flow-control valve is also attached permanently in the air hose and cannot be casually removed.

107. An air pressure release valve, or air vent valve. This is used primarily to deflate the cushion and lower the person sitting on the cushion. This is a twist-to-open, a push-to-open, or a similar type valve which allows air flow out of the cushion. This valve design also makes it possible to regulate the escape of air in case the user wishes to be lowered more slowly. This valve design is easy to use with repeatable and predictable results.

108. Foam support with fabric cover. Attached to the top outside of the cushion is a foam support which is approximately 5 to 8 cm in diameter. This foam is covered with elastic fabric which is sewn to the fabric outer container. This fabric is formed into a circle or semi-circle approximately 2/5 of the diameter of the fabric cushion. This functions to allow the user to feel the proper center seating position when the cushion is inflated. When the cushion is deflated and is essentially flat, this foam support forms a raised boundary on the cushion. The foam helps to keep the user's buttocks centered in the cushion in preparation for inflation. This foam support also allows the user to feel the correct seating area while the cushion is in the deflated and flat condition.

109. An inflatable cushion. This cushion has the inflated expandable air bladders placed inside to provide shape, lift, and support. This cushion is comprised of an outer container or cover made of layers of durable water-resistant fabric. These layers can be connected by needle and thread sewing or by using a strong adhesive. The layers can be made of a durable fabric such as canvas, denim, cotton, or a man-made polyester or vinyl fabric, or any similar water-resistant fabric. This fabric may be vinyl-coated or vinyl-laminated. The fabric will be soft and compliant, yet strong and resilient enough to resist being torn or punctured by normal exposure to the environment. The fabric will be soft and compliant in the center when the cushion is fully or partially inflated, yet firm, stable and supportive around the perimeter when the air tubes are fully inflated. When the cushion is used with the air by-pass valve and the provided air pump, this strong fabric cover will help eliminate the possibility of the cushion bursting due to accidental over-inflation. These cushions may be inflated simultaneously or sequentially.

This outer fabric container will have one or more compartments which can securely hold the expandable bladders which can be filled with compressed air. This outer container can include a handle 111 to provide a grip when moving the cushion. The fabric of the cushion can be any shape compatible with the intended use: rectangular, square, triangular, etc. which will then contain an air-tight expandable bladder. The key design characteristic is that these layers have a common opening to access the interior of the cushion's compartments.

110. A foam support ring with a fabric cover. Attached to the bottom outside of the cushion is a soft foam support ring which is approximately 5 to 8 cm in diameter. This foam ring is covered in a sleeve of water-resistant, stretchable fabric such as spandex, nylon, polyester, or other man-made fabric. This fabric is formed into a circle or semi-circle and attached to the bottom of the cushion. The soft foam support is then place inside this fabric. This foam ring horizontally stabilizes and supports the cushion by limiting the front to back and side to side rolling movement of the cushion during all conditions of inflation.

When the cushion is deflated and is essentially flat, this foam ring forms a raised boundary under the cushion and helps to keep the user's buttocks centered on the cushion in preparation for inflation. This foam ring also allows the user to actually feel the correct seating area while the cushion is in the deflated and flat condition. The combination of both a top and bottom foam support will have the effect of increasing the sensation of a bowl-shaped seating area when the cushion is deflated. This will greatly reduce the possibility of the user accidentally shifting away from the center of the seating area and thus being out of position when the cushion is inflated. This raised foam boundary is particularly helpful if the deflated cushion is moved or relocated by the user before it is re-inflated.

111. A fabric handle attached for ease of movement of the cushion.

Illustration 12/17,

A lifting device with three or more compartments and expandable bladders. For most situations the described cushion with two compartments 109 will be sufficient to raise and lower a person with a body weight of 135 kilograms or less and a height of 2 meters or less to a seated position of 45 cm from the floor level. In the event that a taller or heavier person needs a lifting cushion which provides addition lift, a cushion can be constructed with three inner compartments and three expandable bladders. This can be done by simply sewing an additional third compartment 124 to the bottom of the main cushion 109. The air supply hose for the third layer can be simply connected to the existing supply line 105 in order to allow inflation and deflation with the other air tubes.

This third compartment will normally be shorter to provide additional lift of only 5 to 10 cm, although any size compartment can be constructed. This bottom compartment can also be constructed to be several centimeters larger in diameter for enhanced stability. A solid foam support ring 110 will then be attached to the bottom of the third cushion to provide increased stability.

Using this same construction design and method, a variety of cushions can be constructed in a wide range of sizes and shapes which can support and lift much larger people, or larger and heavier objects such as animals, household furnishings, and even mechanical equipment. In these cases a larger air pump can be used to speed the inflation process. In any situation the basic construction design of the device and the method will be effective and useful.

Illustration 13/17

At the bottom of the page is seen the completed three-compartment device as discussed under illustration 12/17.

When any lifting cushion is used in a bathing situation, an additional plastic handle 125 can be supplied which will attach to the bathtub's surface or wall area by means of a strong suction cup attachment. This plastic handle is currently available and can be purchased from a variety of supply sources. This handle is not intended to support the weight of the user but only to provide a ready point of stability for balance and control while the user is being moved up or down.

Illustration 14/17

Alternate construction patterns. This allows the cushions made from expandable bladders and fabric to be attached together horizontally and/or vertically to create a variety of shapes using the construction and design principles described herein.

Variations on the construction design include connecting the inflatable cushions horizontally and/or vertically using, for example, hook and loop fabric connections. This would then create a structure similar to a 'lifting-bed' 126 which would use four expandable bladders instead of two. A table or carrying tray 127 can be placed on the lifting cushion to support the shape and weight of the person or object being moved.

Using similar construction techniques a 'raised-platform' type device 128 can be constructed for use on solid surfaces or as a floating device on a liquid surface.

Sewing can be used to permanently connect the fabric cushions, or using a temporary connecting method such as hook and loop fasteners, buckles, snaps, etc. a device can be made which could easily be reconfigured or dis-assembled for storage or relocation. The main advantage of this design is the component-based nature of the lifting cushion. This allows individual pieces of the device to be independently repaired or replaced without adversely affecting the utility of the entire assembly.

Illustration 15/17

Another variation in product design and use is a single layer lifting cushion used to assist people when rising from a low position on a chair, couch, or bed. The top view 129A and side view 129B of the device can be seen with the needed air tubes 121, connections 122, and expandable bladder 119.

Illustration 16/17

The single layer lifting cushion 130 is shown being used on a chair. This device is shown with an optional upper 108 and lower 110 foam support. These supports may be deleted or modified without affecting the utility of the cushion for lifting short distance.

Operation

One of the main objectives in the design of this device and method was to provide a design which was very simple to assemble and operate. For that reason each of the possible embodiments of this device is simple to operate. Each embodiment is similar in operation.

The nature of the device requires only two basic operations and actions to be needed. The first action is to inflate the cushion to a full firm state, then stop the inflation process so as to not over-inflate the device. This action raises the person or load placed on the cushion. The second action is to release the enclosed air and deflate the cushion. This action lowers the person or load placed on the cushion.

The improved design of the device provides advantages over prior art which do not need additional user input or control. The device has improved durability, visual appeal, support structures, horizontal stability, and comfort by simply functioning properly.

EMBODIMENTS

There are numerous embodiments possible with this design. A few of these have been previously mentioned and illustrated. They include the following:

1. The 'personal cushion lift' which is designed to move an individual or small object to and from the floor. This is also designed to be used in the bathtub.
2. Another embodiment is the 'cushion lift chair' which is designed to raise and lower a person or small object up and down from a low position on a wheel-chair, couch, or bed.
3. Another embodiment is the 'extended cushion lift' which is designed to provide additional lift for people of a taller stature.
4. Another embodiment is the 'lifting bed' which is designed to raise and lower large objects, or people in a reclined position.
5. Another embodiment is the 'raised platform' which is designed to support large objects on a solid or liquid surface.
6. Another embodiment is the 'cushion lift pillow' which is designed to increase the comfort of the user while the cushion is either inflated or deflated.

CONCLUSION

Objectives of this New Device

One of the objectives of this new device is to design an inflatable cushion which provides assistance in raising and lowering people who are unable to move freely by themselves. The goal is to provide such a device which does not suffer from the problems or deficiencies associated with prior art.

It is desirable to have a device that has inflatable bladders covered with durable, water-resistant fabric. This new device has a compliant seating surface which conforms to the shape of the person being assisted. This device has a pneumatically inflatable cushion which is designed to naturally center, stabilize, and support the user of the cushion at all times. The durable fabric covering of this device protects the inflatable bladders from punctures and tears caused by the environment. This outer fabric covering also improves the appearance and visual appeal of the device. This fabric covering is extremely resistant to damage from severe use or adverse conditions from the surrounding environment.

Still further, when used in the bathtub, this device is designed for ease of movement across the surfaces upon which it is placed, both while inflated and deflated. This is made possible by the innovative design which incorporates a foam support ring on the bottom which minimizes the horizontal leaning movements of the inflated cushion. This allows the user to easily relocate to either a seated position or a reclining position during the bathing experience. The user remains centered on the deflated cushion which is still able to move under all conditions. The device can also be deflated and removed entirely from the bathtub allowing the user complete freedom while in the bath. The cushion can then be replaced under the user when needed and inflated to provide assistance in rising from the bath.

Moreover, this same device can also be used in situations other than bathing to assist in raising and lowering persons and items to and from the floor and ground. It can be advantageously used both indoors and outdoors, and for people or any heavy or awkward item. It can be used for luggage, large grocery goods, heavy boxes, and even plants and landscaping items in the yard.

This new device can be used to assist those who are care givers, by minimizing the possibility of back, shoulder, and neck injuries caused by physically lifting or carrying the body weight of the person in need of care. This device can be used as a support tool in a wide variety of care-giving situations to reduce the risk of injury to those involved. It is both lightweight and compact enough to be easily carried in a hand-held utility bag. The entire device can be easily stored in a compact space for future use.

Furthermore this device is a component-based design which allows it to be quickly and easily repaired in case of damage or partial failure. This makes it possible to replace only the damaged component rather than the entire unit. This allows the owner to be assured that the device can be easily serviced in case of damage. This also allows the device to continue in use for an extended time period with only minor repair or partial replacement.

It can be used on a larger scale as a single unit, or used as an integrated, multiple-unit device. It is possible to easily and safely lift or lower large rocks, automotive parts, and even furniture and large animals. Veterinary services, automotive repair shops, landscaping and yard care services, etc. can use such a mobile device for raising and lowing heavy items in order to lessen the risk of personal injury to the workers.

SCOPE AND IMPLICATIONS

Due to the innovative construction using a sewn outer fabric covering, this device is extremely durable and able to be used confidently in a wide variety of locations and environments. This differs from similar devices previously designed and produced, which are intended primarily for use indoors or in controlled settings. Although similar devices are presented as being usable occasionally outdoors for lifting or lowering users, the fact is that most could not withstand the rigors of outdoor use without damage or product failure. This new device allows users to receive assistance from a caregiver in settings which have previously been challenging or impossible to access. This device and method assist both the user and the caregiver.

Of primary importance with regard to the structure is the materials from which this device is made. This device is novel to this application because it is made with inflatable air tubes contained inside a cushion structure made of resilient fabric. This results in increased durability when compared to similar products without a protective fabric outer cover. This is especially useful in the demanding outdoor settings in which this device is designed to be used. The materials used in the construction of this product have been used extensively in outdoor conditions with success and long life.

This entire device is purposely constructed from a variety of components which are commonly and widely available. This component-based design allows easy repair and service in the event of damage or failure of a single component of the device. This promotes long life and therefore value of the device.

The design of this device allows for both expandable height and width which promotes stability and comfort. Although not specifically designed for extreme use, this device could be expanded and upgraded sufficiently to support the size and weight of large and even obese people. Prior similar devices of this type are limited by their structure and size.

Also adding to the user's enjoyment of the experience is the fact that the air pump is located at a substantial distance from the point of cushion use. The air pump is typically in another room which is 5 to 6 meters away. This allows the air pump to function without intrusive noise upon the user.

As opposed to similar devices using a rectangular bench-type design, this round design is less intrusive to the personal space of the user. This device features a foam ring support attached to the bottom and another on top of the cushion which acts to stabilize the cushion's movement when it is fully inflated. This round design and structure naturally form a shallow bowl shape to the top layer of fabric which stabilizes and supports the user. This bowl-shape or donut-shape is incorporated into the design of both the inflated and deflated cushion. When the cushion is fully deflated, these solid foam rings serve as a boundary to limit the outward movement of the user and orient the user to the center area in preparation for inflation of the cushion. This promotes comfort and ease of use for the person receiving care.

Combined with the durable materials used in construction, the capability of indoor and outdoor use, the foam supports which stabilize both the cushion and the user at all times, the movable nature of the deflated cushion in the bathtub, the simplicity of operation, and the ability to customize the size, shape and configuration of the final device, this design is superior to previous devices.

The invention claimed is:

1. A machine comprising:

at least one expandable bladder made from a durable, highly elastic material, having a connective opening for adding and removing an intervening gaseous substance which causes expansion or contraction of said at least one expandable bladder;

an outer container comprising a series of sheets of durable material which is inelastic, malleable, substantially thin, and made from a synthetic or natural substance, said series of sheets of durable material having a similar shape and size, and being contiguously connected at an outer perimeter, said outer container forming at least one inner compartment entirely enclosing and surrounding said at least one expandable bladder, said at least one inner compartment having a bottom opening for interior access, said outer container forming a top surface, a bottom surface, and a side surface which are contiguous, thereby creating an exterior surface of said machine, said outer container further comprising at least one foam support attached in a circular concentric position on said top surface or on said bottom surface or on both for increasing a horizontal stability of said machine;

said at least one expandable bladder is held securely in place within said at least one inner compartment of said outer container by a series of centrally extending restraints; and a tube for directing and channeling said intervening gaseous substance through said connective opening of said at least one expandable bladder, said tube being contained and concealed inside said at least one inner compartment, said tube connecting to a source of said intervening gaseous substance outside said machine, whereby said machine will expand to create upward movement and linear lift and contract to create downward movement and linear support while maintaining said horizontal stability of said machine.

2. Said machine of claim 1 wherein said at least one expandable bladder comprising said durable, highly elastic material including a natural or synthetic rubber, and is in a shape of a ring with an open center area surrounded by an inflatable, circular, tubular container which expands to substantially fill said at least one inner compartment in which it is entirely enclosed and contained, said top surface of said outer container becoming more firmly supported by said at least one expandable bladder around said outer perimeter and less firmly supported over said open center area when said at least one expandable bladder is fully inflated, whereby a middle area of said top surface of said outer container is softer and more compliant for a user who may utilize said machine as a device for sitting upon, said user having his buttocks naturally centered, supported and stabilized while said at least one expandable bladder is inflated.

3. Said machine of claim 2 wherein said outer container comprising said series of sheets of durable material which includes a fabric made from a natural or man-made substance further including a variety of possible textures, colors, and solid or varied design patterns, whereby an outward appearance of said exterior surface is quickly and easily customized during construction so as to be attractive and visually appealing to said user, said outer container further including a hand-grip for ease of handling said machine.

4. Said machine of claim 3 wherein said outer container comprising said series of sheets of durable material being contiguously connected at said outer perimeter and at other areas through a construction method comprising needle and thread sewing, or heat bonding, or use of an adhesive agent, whereby said series of sheets of durable material are able to securely form said outer container which can entirely enclose and surround said at least one expandable bladder, said outer container providing structure and support which assures a linear vertical movement of said machine upon introduction of said intervening gaseous substance.

5. Said machine of claim 4 wherein said at least one expandable bladder is held centrally and securely in place by said series of centrally extending restraints comprising strips of a primary fabric attached to said outer container using said construction method comprising needle and thread sewing and a secondary fabric comprising a hook and loop fastener said series of centrally extending restraints passing through or around said at least one expandable bladder whereby said at least one expandable bladder is secured and stabilized in a center position of said at least one inner compartment during inflation and deflation, thus assuring said machine can provide said linear vertical movement in a range of 100 mm to 300 mm from each said at least one expandable bladder.

6. Said machine of claim 5 wherein said at least one foam support is an elongated, foam cylinder comprising a soft compliant material including polyethylene foam or polyurethane foam, said at least one foam support being attached in said circular concentric position on said bottom surface and/or said top surface of said outside container, said at least one foam support being contained within a flexible sleeve constructed using an elastic fabric and said hook and loop fastener which is attached to said exterior surface using said construction method comprising needle and thread sewing, whereby said horizontal stability of said machine is greatly increased during inflation, and said user or an object being moved is supported in said middle area of said top surface during horizontal and vertical movement while said machine is inflated or deflated.

7. Said machine of claim 6 wherein said tube for directing and channeling said intervening gaseous substance is composed of vinyl, plastic, or rubber, and is non-expanding, said intervening gaseous substance comprising an atmospheric air or an inert gas, said tube being placed inside a narrow sleeve comprising fabric or vinyl which is attached to said at least one inner compartment and routed near said outer perimeter in a way which avoids contact with said user of said machine while in use as said device for sitting upon, whereby said at least one expandable bladder can be inflated to a firm state while continuing to provide comfort for said user.

8. Said machine of claim 7 wherein said tube for directing and channeling said intervening gaseous substance includes a series of connections and pathways, said tube further including an inline check-valve for limiting a flow of said intervening gaseous substance to only one direction, whereby said at least one expandable bladder remains inflated for extended periods of time without maintenance.

9. Said machine of claim 8 wherein said tube for directing and channeling said intervening gaseous substance further includes a connection with a spring-actuated by-pass valve which automatically opens and vents excess pressure when a predetermined maximum pressure point is reached, whereby said at least one expandable bladder is not over inflated and damaged.

10. Said machine of claim 9 wherein said tube for directing and channeling said intervening gaseous substance further includes a manually actuated pressure release valve, whereby said at least one expandable bladder may be deflated by said user and said machine returned to an empty and flattened state.

11. Said machine of claim 10 wherein said machine includes two or more of said at least one expandable bladder, each one enclosed within a distinct and separate said at least one inner compartment, said tube for directing and channeling said intervening gaseous substance further including at least one section with an inline spring-actuated valve which remains closed until said tube reaches a predetermined minimum pressure at which point said inline spring-actuated valve automatically opens, thereby causing a limited number of said at least one expandable bladder to be filled first while said inline spring-actuated valve is closed, and others to be filled afterward when said inline spring-actuated valve opens, whereby said at least one expandable bladder may be selectively and sequentially inflated, thereby increasing said horizontal stability of said machine.

12. Said machine of claim 11 wherein said source of said intervening gaseous substance comprises an air pump or a pressurized container, whereby said at least one expandable bladder may be inflated.

13. Said machine of claim 12 wherein a motivating power for said air pump comprises an electric power source providing direct current or alternating current, said air pump being activated and deactivated using a wireless remote control device which interrupts said electric power source, whereby said electric power source is isolated from said user, thus ensuring safety and utility of said machine.

14. Said machine of claim 13 wherein said at least one expandable bladder comprising said natural or synthetic rubber, said outer container comprising said series of sheets of durable material which form said at least one inner compartment, said outer container's said construction method comprising needle and thread sewing, said outer container having increased stability by said at least one foam support on said bottom surface, said at least one expandable bladder being held centrally and securely in said at least one inner compartment by said series of centrally extending restraints, said at least one inner compartment further having said narrow sleeve comprising fabric or vinyl securely holding said tube in place, said tube for directing and channeling said atmospheric air includes said series of connections and pathways, said spring-actuated by-pass valve with said predetermined maximum pressure point, said inline check-valve limiting said flow to a single direction, said manually actuated pressure release valve, said atmospheric air being pressurized and supplied by said air pump, said machine thereby forming a single functional device to provide said linear vertical movement, which creates lift and support, said machine further including a series of external connecting points on said outer container comprising said fabric made from said natural or man-made substance and said hook and loop fastener, thereby two or more examples of said machine may be temporarily connected and combined to operate in unison, whereby a multitude of shapes, sizes, and configurations of said machine can be easily and quickly assembled, configured, connected, and then disassembled, thus providing equipment which allows rapid response by emergency rescue workers and personal caregivers to a variety of situations on land, snow, or water surfaces.

* * * * *